United States Patent [19]

Rerek

[11] Patent Number: 4,728,455

[45] Date of Patent: Mar. 1, 1988

[54] DETERGENT BLEACH COMPOSITIONS, BLEACHING AGENTS AND BLEACH ACTIVATORS

[75] Inventor: Mark E. Rerek, Fanwood, N.J.

[73] Assignee: Lever Brothers Company, New York, N.Y.

[21] Appl. No.: 837,613

[22] Filed: Mar. 7, 1986

[51] Int. Cl.[4] ..... C11D 7/18

[52] U.S. Cl. ..... 252/99; 252/95; 252/186.38; 252/186.26; 252/89.1; 502/150; 502/170; 502/172; 8/111

[58] Field of Search ..... 252/91, 99, 95, 186.38, 252/186.2, 89.1; 502/150, 170, 172; 8/111

[56] References Cited

U.S. PATENT DOCUMENTS

| | | | |
|---|---|---|---|
| 3,303,104 | 2/1967 | Rubin | 252/99 |
| 4,049,467 | 9/1977 | Rubin | 252/99 |
| 4,283,300 | 8/1981 | Kurtz | 252/95 |
| 4,390,351 | 6/1983 | Havinga et al. | 252/174.19 |
| 4,430,243 | 2/1984 | Bragg | 8/111 |
| 4,478,733 | 10/1984 | Oakes | 252/99 |
| 4,483,778 | 11/1984 | Thompson et al. | 252/91 |
| 4,539,130 | 9/1985 | Thompson et al. | 252/91 |
| 4,626,373 | 12/1986 | Finch et al. | 252/99 |

FOREIGN PATENT DOCUMENTS 124341 11/1984 European Pat. Off. .
157483 10/1985 European Pat. Off. .

OTHER PUBLICATIONS

Chem. Abstracts 87:99004k.
Chem. Abstracts 97:227307g.

*Primary Examiner*—Josephine L. Barr
*Attorney, Agent, or Firm*—Milton L. Honig; James J. Farrell

[57] ABSTRACT

Bleaching agent compositions and detergent bleach formulations containing them comprise effective amounts of (a) a peroxide compound having a bleaching action; and (b) a catalyst for the bleaching action of the peroxide compound, said catalyst comprising a water-soluble complex of manganese (III) with a multidentate ligand. The amount of complexing agent in the catalyst that supplies the multidentate ligand to form the complex is such that the molar ratio of complexing agent to manganese is at least about 1:1, preferably 10:1 or greater.

42 Claims, No Drawings

DETERGENT BLEACH COMPOSITIONS, BLEACHING AGENTS AND BLEACH ACTIVATORS

TABLE OF CONTENTS

Background of the Invention
Technical Field
Description of Related Art
Summary of the Invention
Description of the Preferred Embodiments
Example I
Example II
Example III
Example IV
Example V
Example VI
Example VII
Claims

BACKGROUND OF THE INVENTION

1. Technical Field

This invention relates to detergent bleach formulations containing a bleaching agent, that are suitable for washing fabrics and removing stains on fabrics. The bleaching agent can be hydrogen peroxide or a water-soluble peroxide adduct, e.g., one or more inorganic persalts which liberate hydrogen peroxide in aqueous solution such as alkali metal perborates, percarbonates, perphosphates, and persilicates.

Description of Related Art

Peroxide bleaching agents for use in laundering have been known for many years. Such agents are effective in removing stubborn stains from clothing such as tea, fruit and wine stains. However, the efficacy of peroxide bleaching agents drops off sharply below 60° C. Consequently, bleach catalysts or heavy metal bleach activators have been employed to achieve satisfactory bleaching at the lower wash temperatures needed to avoid scalding of laundry workers and household consumers of laundry detergents. However, heavy metal catalysts, for example as described in U.S. Pat. No. 3,156,654, tend to promote the decomposition of hydrogen peroxide by reaction mechanisms which do not contribute to the desired bleaching effect, with consequent loss of bleaching performance. To control such loss of hydrogen peroxide, sequestrants for the heavy metals, such as ethylenediaminetetraacetic acid (EDTA) and diethylenetriaminepentaacetic acid (DETPA) or their salts have been added to detergent bleach formulations. Unfortunately, sequestrants can also inhibit bleaching catalysis so that a balance is needed to maximize bleaching action while minimizing non-bleaching decomposition of the peroxide.

A related, but separate problem is the hydrolytic instability of heavy metal ions under normal (alkaline) wash conditions. Thus, in the absence of sequestering agents, heavy metal hydroxides will precipitate from solution and deposit themselves on the fabrics being laundered. Another problem is oxidative instability of heavy metal ions in the presence of certain non-peroxide oxidizing agents. For example, in the presence of hypochlorite, an oxidizing chlorine bleach which fastidious consumers may add to the wash water in the belief that it supplements the action of the peroxide bleaching agents in the detergent formulation, insoluble heavy metal oxides can form and become deposited on the fabrics. This can happen even in the presence of sequestering agents, which themselves are often susceptible to undesirable oxidation by hypochlorite.

Therefore, for a heavy metal to be useful as a bleach catalyst in a detergent bleach formulation, the heavy metal must not unduly promote peroxide decomposition by nonbleaching pathways and must be hydrolytically and oxidatively stable. The patent literature discusses the use of chelating agents to impart both hydrolytic and oxidative stability to the metal center. Thus, European Patent Application No. 84302774.9 describes the use of hydroxycarboxylic acids as "bleaching auxiliaries" to provide hydrolytic and oxidative stability to ferrous and ferric ions in solution. U.S. Pat. No. 4,478,733 discloses the use of Mn(II) as a peroxide bleach catalyst in detergent compositions containing perborate, aluminosilicate, and orthophosphate over the temperature range 20°–60° C. Likewise, U.S. Pat. No. 4,430,243 indicates that manganese (III) activates perborate bleaching in a detergent formulation. However, none of the prior art provides a heavy metal-based bleach catalyst that is entirely free of the foregoing drawbacks.

Accordingly, it is an object of the present invention to provide new, improved detergent bleach formulations.

Another object of the invention is to provide aqueous laundry wash media containing new improved detergent bleach formulations.

Another object of the invention is to provide new, improved bleaching agent compositions for use in detergent formulations.

Another object is to provide a new system for catalyzing the action of bleaching agent compositions.

Yet another object is to provide a method of producing a new system for catalyzing the action of bleaching agent compositions.

These and other objects of the invention as well as a further understanding of the features and advantages thereof, can be had from the following description and claims.

SUMMARY OF THE INVENTION

The foregoing objects are achieved according to the present invention which provides novel peroxide bleach catalyst, promoter or activator systems for use in laundry detergent and/or bleaching applications. The bleach catalysts or activators are based on tripositive manganese ion, Mn(III), and are safe to both the consumer and the environment, while providing improved bleaching activity over the entire ranges of wash temperatures, soil loads, and water hardnesses encountered in laundering of clothing and other articles. In addition, the Mn(III)-based compositions described herein are resistant to both hydrolysis and oxidation, thus providing a significant improvement in stability over peroxide bleach catalysts based on dipositive manganese ion, Mn(II). In addition to increasing peroxide bleaching efficacy, the bleach promoters or catalysts of the invention actively inhibit the undesirable peroxide decomposition that occurs in the presence of other manganese species independently of bleaching, thus optimizing bleaching performance for any level of peroxide bleach dosage and minimizing the amount of peroxide bleach necessary to achieve satisfactory bleaching. The invention also provides a peroxide bleach catalyst that is stable to oxidants such as hypochlorite which would otherwise cause the formation of $MnO_2$ which can form deposits upon and stain fabrics.

In particular, the invention provides a detergent bleach formulation comprising (a) one or more surface active agents selected from the group consisting of nonionic, anionic, cationic, and zwitterionic detergents; (b) a detergent builder; and (c) a bleaching agent containing (i) one or more peroxide compounds having a bleaching action, and (ii) a catalyst for the bleaching action of the peroxide compound(s), comprising a water-soluble complex of manganese (III) and a multidentate ligand derived from a complexing agent, said catalyst containing sufficient ligand-supplying complexing agent such that the molar ratio of complexing agent to Mn(III) is at least about 1:1.

The composition can be formulated by combining effective amounts of the components (a), (b) and (c)(i) and (ii) as substantially dry solids. The term "effective amounts" as used herein means that the ingredients are present in quantities such that each of them is operative for its intended purpose when the resulting mixture is combined with water to form an aqueous medium which can be used to wash clothes, fabrics and other articles. In particular, the composition can be formulated to contain a surface active agent in an amount of from about 2% to about 50% by weight, preferably about 5% to 30%, of the composition; from about 1% to about 85% by weight, preferably about 5% to 50%, detergent builder; and from about 5% to about 30% by weight, preferably about 15% to 25%, peroxide compound.

The catalyst component is a novel feature of the invention. The effective level of the catalyst component, expressed in terms of parts per million (ppm) of Mn(III) in the aqueous wash liquor or solution, ranges from 0.1 ppm to 4 ppm, preferably 0.5 ppm to 2.5 ppm. Above 4 ppm, the wasteful manganese catalyzed peroxide decomposition pathway becomes dominant. When the detergent bleach composition of the invention is used at concentrations in the wash water of about 2 g/l or 0.2% by weight normally employed by consumers in the United States, this corresponds to a manganese content in the detergent bleach composition of 0.005% to 0.2% by weight, preferably 0.025% to 0.125% by weight, based on the total weight of the detergent bleach composition. When used at the typical European dosages of 6 g/l or 0.6%, this corresponds to a manganese content in the detergent composition of about 0.0017% to 0.066% by weight, preferably about 0.008% to 0.042% by weight based on the total weight of the detergent bleach composition. The molar ratio of complexing agent to manganese (III) in the catalyst is especially important and "effective amounts" of these ingredients connotes that such ratio be at least about 1:1, and preferably from about 10:1 to about 100:1; although ratios as high as 1000:1 can be used. I have discovered that the aforementioned ratio of complexing agent to manganese maintains the Mn(III) in the complex as the active manganese species.

The action of the catalyst is believed to be due to the presence of a water-soluble complex of manganese(III) and a multidentate ligand wherein the complex catalyzes peroxide bleaching activity while inhibiting non-bleaching peroxide decomposition. Further, the multidentate ligand, which will be described in greater detail hereinbelow, imparts both hydrolytic and oxidative stability to the Mn(III). This prevents the formation of water-insoluble manganese species such as $MnO_2$, which tends to promote undesirable peroxide decomposition and stain fabrics through deposition as a precipitate.

A manganese(III) complex suitable for use in the present invention must meet the following three criteria:

1. It must be stabile in a solution of the detergent bleach composition with respect to hydrolysis which would result in the formation of insoluble metal compounds at the alkaline pH's which are normally encountered in laundry wash water (hydrolytic stability);
2. It must be stabile with respect to oxidation which would result in the formation of insoluble metal compounds at alkaline pH's in the presence of sodium hypochlorite, or other strongly oxidizing species which the user of the detergent bleach composition may choose to add to the wash water (oxidative stability); and
3. It must effectively catalyze peroxide bleaching activity.

Such complexes normally form homogeneous, non-colloidal solutions in alkaline aqueous systems.

Criterion (1) prevents formation of MnO(OH), $Mn_2O_3\ xH_2O$ and $Mn(OH)_3$; criterion (2) prevents formation of $MnO_2$. Both $MnO(OH)/Mn(OH)_3/Mn_2O_3\ xH_2O_3$ and $MnO_2$ are detrimental to Mn(III)-catalyzed peroxide bleaching. Thus, at pH's of 9 to 12 which are normally encountered in aqueous wash media containing the detergent bleach composition of the invention, the water-soluble complex of Mn(III) with the multidentate ligand catalyzes the bleaching activity of the peroxide compound while itself being stable to hydrolytic and oxidative degradation to water-insoluble manganese species.

Peroxide compounds suitable for use in the present invention include water-soluble inorganic persalts which yield hydrogen peroxide when dissolved in water. These include the alkali-metal perborates, percarbonates, perphosphates, and persilicates. Inorganic persalts which are available in the hydrated form are preferred in cases where they are more water-soluble than their anhydrous counterparts. Of the hydrated inorganic persalts, sodium perborate monohydrate is especially preferred.

Complexing agents, which are suitable for use as a source of multidendate ligands in the present invention by virtue of their ability to stabilize Mn(III), are hydroxycarboxylic acids containing 5 or more carbon atoms, and the salts, hydrolyzable lactones, acid esters, ethers and boric esters thereof. A preferred group of the aforesaid hydroxycarboxylic acids can be represented by the general formula (I):

$$R[C_n H_{2n-m} (OH)_m]CO_2H \qquad \text{I}$$

wherein R is $CH_2OH$, CHO or $CO_2H$; n is from 3 to 8, preferably 4; and m is from 3 to n, preferably 4. Of these types of species, the alkali metal salts and especially the sodium salts, are preferred. The hydroxycarboxylic compounds are stable at alkaline pH's (9–12) and have a hydroxyl group on each of the carbon atoms other than the carboxyl carbon; alternatively, the hydroxycarboxylic acid can have an aldehyde or carboxylic group on another carbon atom, and, in the case of straight-chain compounds, on the carbon atom farthest from the carboxyl carbon, and each of the remaining carbon atoms has a hydroxyl group. Examples of suitable hydroxycarboxylic acids are the hexonic hydroxyacids such as gluconic acid, gulonic acid, idonic acid and mannoic acid; the uronic acids such a glucouronic acid, galactouronic acid and mannuronic acid; the heptonic hydroxyacids such as glucoheptonic acid and its stereoisomers and mixture thereof; and sugars such as saccharic acid and isosaccharic acid.

The use of the foregoing complexing agents according to the present invention gives unexpected results in view of the fact that other, similar compounds such as malic acid, citric acid and tartaric acid and the related amine carboxylic acids such as EDTA do not impart the requisite hydrolytic and oxidative stability to the Mn(III). I have discovered that there is a delicate balance between Mn(III) stability and instability in these systems.

In another aspect, the present invention provides a bleaching agent composition containing (a) a peroxide compound having a bleaching action; and (b) a catalyst for the bleaching action of the peroxide compound, said catalyst comprising the aforesaid water-soluble complex of manganese (III) with a multidentate ligand.

The invention also embodies a method for preparing the catalyst for the bleaching action of the peroxide compound, which comprises:

(a) preparing an aqueous solution of a precursor of Mn(III), e.g., a manganese (II) salt, and a multidentate ligand-supplying complexing agent wherein the molar ratio of the complexing agent to manganese is at least about 1:1;

(b) adjusting the solution prepared in step (a) to a pH of about 9 to 12; and (c) when the Mn(III) precursor is a Mn(II) salt, agitating the solution in step (b) in air to oxidize the Mn(II) selectively to Mn(III) whereby a water-soluble complex of manganese(III) with the multidentate ligand is formed.

More particularly, the catalyst can be formed by preparing a neutral (pH about 7) solution of the desired complexing agent, e.g. sodium gluconate, and a precursor of Mn(III), viz., a manganese(II) salt, typically a Mn(II) salt of an inorganic acid, such as $MnCl_2$, $Mn(NO_3)_2$, $Mn_3(PO_4)_2$, and $MnSO_4$, and preferably manganese(II) sulfate. (Another precursor of Mn(III) is Mn(IV), which is the form in which complexed manganese such as the gluconate complex exists at pH greater than about 13 and which becomes converted to Mn(III) when the pH is lowered to within the range of between about 9 and 12). The amount of complexing agent relative to the Mn(II) salt is at least an equimolar amount, and preferably a 10- to 100-fold molar excess of the complexing agent is used. The pH of the solution is adjusted to between about 9 and about 12, preferably between 10 and 11, by adding, e.g., sodium hydroxide, and the solution is stirred in air as a source of oxygen. Oxidation of Mn(II) to Mn(III) occurs with rapid complexation of Mn(III) with the ligand-supplying complexing agent. If a solid composition is desired, the solution can be evaporated to dryness by means well known to those skilled in the art. Alternatively, the catalyst can be formed by dissolving the desired complexing agent in an aqueous solution of an Mn(III) salt, for example, manganese(III) acetate which is commercially available. The pH of the system is adjusted to about 10, e.g., by addition of 1N NaOH. The solution is evaporated to dryness to obtain a solid complex of Mn(III) with ligand supplied by the complexing agent. The stoichiometries of the manganese(III) salt and complexing agent are determined by the desired ratio of complexing agent to Mn(III).

The bleach catalyst is compatible with common detergent builders such as carbonates, phosphates, silicates and zeolites. Carbonates, e.g., sodium carbonate, can be present in the detergent composition in amounts from 1% to 50% by weight; the upper limit is defined only by formulation constraints. Zeolites, e.g., Zeolite 4A, can be added at levels of 5% to 25% by weight as can sodium tripolyphosphate or orthophosphate, and sodium silicates commonly used in detergents, e.g., wherein the $SiO_2/Na_2O$ ratio ranges from 1:1 to 3.5:1. This allows for the control of wash water hardness so that detergency can be maximized. Furthermore, the bleach catalyst is effective in the presence of common sequestrant builders such as EDTA; DETPA, or aminotrimethylenephosphonic acid pentasodium salt (Dequest 2006). These can be added typically at levels of about 0.05% to about 0.3% by weight and at these levels, catalytic bleaching activity is not adversely affected. Examples of organic builders are alkylmalonates, alkylsuccinates, polyacrylates, nitrilotriacetates (NTA), citrates, carboxymethyloxymalonates and carboxymethyloxysuccinates.

As indicated above, the detergent bleach compositions of the present invention contain a surface-active agent or surfactant, generally in an amount of from about 2% to 50% by weight, preferably from 5% to 30% by weight. The surface-active agent can be anionic, nonionic, cationic or zwitterionic or a mixture of such agents.

Nonionic surfactants suitable for use in the present invention include water-soluble compounds produced by the condensation of ethylene oxide with a hydrophobic compound such as an alcohol, alkyl phenol, polypropoxy glycol, or polypropoxy ethylene diamine. Also suitable are alkyl amine oxides, alkyl polyglucosides and alkyl methylsulfoxides. Preferred nonionic surfactants are polyethoxy alcohols formed as the condensation products of 1 to 30 moles of ethylene oxide with 1 mole of branched or straight chain, primary or secondary aliphatic alcohols having from about 8 to about 22 carbon atoms; more especially, 6 to 15 moles of ethylene oxide are condensed with 1 mole of straight or branched chain, primary or secondary aliphatic alcohol having from about 10 to about 16 carbon atoms. Certain polyethoxy alcohols are commercially available under the trade-names "Neodol", "Synperonic", and "Tergitol".

Anionic surfactants suitable for use in formulating the detergent bleach compositions of the invention include water-soluble alkali metal alkylbenzenesulphonates, alkyl sulphates, alkylpolyethoxyether sulphates, paraffin sulphonates, alpha-olefin sulphonates, alphasulphocarboxylates and their esters, alkylglycerylethersulphonates, fatty acid monoglyceridesulfates and sulfonates, alkylphenolpolyethoxy ethersulphates, 2-acyloxyalkane-1-sulphonates, and betaalkyloxyalkanesulphonates. Soaps can also be used as anionic surfactants. Preferred anionic surfactants are alkylbenzenesulphonates with about 9 to about 15 carbon atoms in a linear or branched alkyl chain, more especially about 11 to about 13 carbon atoms; alkylsulphates with about 8 to about 22 carbon atoms in the alkyl chain, more especially from about 12 to about 18 carbon atoms; alkylpolyethoxy ethersulphates with about 10 to about 18 carbon atoms in the alkyl chain and an average of about 1 to about 12 $-CH_2CH_2O-$ groups per molecule; linear paraffin sulphonates with about 8 to about 24 carbon atoms, more especially from about 14 to about 18 carbon atoms and alpha-olefin sulphonates with about 10 to about 24 carbons atoms, more especially about 14 to about 16 carbon atoms; and soaps having from 8 to 24, especially 12 to 18, carbon atoms.

Cationic surface active agents suitable for use in the invention include the quaternary ammonium compounds, e.g. cetyltrimethylammonium bromide or chloride and distearyldimethylammonium bromide or chloride, and the fatty alkyl amines.

Zwitterionic surfactants that can be used in the present invention include water-soluble derivatives of aliphatic quaternary ammonium, phosphonium and sulphonium cationic compounds in which the aliphatic moieties can be straight or branched, and wherein one of the aliphatic substituents contains from about 8 to 18 carbon atoms and one contains an anionic water-solubilizing group, especially alkyldimethylammoniopropanesulphonates and carboxylates (betaines) and alkyldimethylammoniohydroxypropanesulphonates and carboxylates wherein the alkyl group in both types contains from about 8 to 18 carbon atoms.

Typical listings of the classes and species of surfactants useful in this invention appear in "Surface Active Agents", Vol. I, by Schwartz & Perry (Interscience 1949) and "Surface Active Agents". Vol. II by Schwartz, Perry and Berch (Interscience 1958). These listings, and the foregoing recitation of specific surfactant compounds and mixtures which can be used in formulating the detergent bleach composition of the present invention, are representative and are not intended to be limiting.

Other components/adjuncts commonly used in detergent compositions and which can be used in the instant detergent bleach compositions include soil-suspending agents such as water-soluble salts of carboxymethylcellulose, carboxy-hydroxymethylcellulose, copolymers of maleic anhydride and vinyl ethers, and polyethylene glycols having a molecular weight of about 400 to 10,000 or more. These can be used at levels of about 0.5% to about 10% by weight.

Dyes, pigments, optical brighteners, perfumes, anticaking agents, suds control agents, enzymes and fillers can also be added in varying amounts as desired.

Fabric-softening agents, both cationic and nonionic in nature, as well as clays, e.g. bentonite, can also be added to provide softening-in-the-wash properties.

The detergent compositions of the invention are preferably formulated as free-flowing particles, e.g., in powdered or granular form, and can be produced by any of the conventional techniques employed in the manufacture of detergent compositions, but preferably by slurry-making and spray-drying processes to form a detergent base powder to which heat-sensitive ingredients, including the peroxide bleaching agent and optionally some other ingredients as desired, and the bleach catalyst, can be added as dry substances. Alternatively, the liquid catalyst solution can be added separately to a wash/bleach water containing the peroxide bleaching agent.

DESCRIPTION OF THE PREFERRED EMBODIMENTS

In its preferred embodiments, the invention uses an aqueous solution containing manganese(II) sulfate and, as the complexing agent, sodium gluconate. The molar ratio of complexing agent to Mn(II) salt in the solution is from about 10:1 and 100:1. The pH is adjusted to about 10 using aqueous sodium hydroxide, and the bleaching agent composition is obtained as a substantially dry, free-flowing solid powder or granular product by removing the water from the oxidized solution. This can be done conveniently by vacuum evaporation.

The invention will be illustrated by the following nonlimiting examples.

EXAMPLE I

In a typical run, 0.338 g $MnSO_4$ and 21.8 g sodium gluconate are dissolved in 500 ml doubly distilled water. Addition of 2 ml of 1N sodium hydroxide raises the pH to 10 and the solution turns from colorless to honey brown. The solution is placed on a rotary evaporator to remove the water, then freeze-dried to a light tan power. The catalyst mixture thus produced is used in the detergent bleach formulations illustrated in examples II and III, below.

Example II

The following detergent bleach composition is formulated:

| Component | % by weight |
|---|---|
| Neodol 45-13 (a $C_{14}$–$C_{15}$ linear primary alcohol ethoxylate (13 EO)) | 6.4 |
| sodium carbonate | 25.0 |
| sodium silicate | 7.5 |
| sodium hydroxide | 0.5 |
| sodium sulfate | 29.0 |
| sodium perborate monohydrate | 20.0 |
| catalyst | 10.0 |
| water to 100% | |

The composition is tested at a dosage of 2 g/l (1 ppm manganese) in a 15-minute wash at 40° C. The bleaching effect on tea-stained cloth measured by ΔR (the change in reflectance between washed and unwashed cloth) at various degrees of water hardness is given in Table I.

TABLE I

| Hardness(FH)* | ΔR |
|---|---|
| 2° | 12.0 |
| 6° | 11.6 |
| 12° | 10.5 |
| 15° | 10.3 |
| 18° | 8.3 |
| 24° | 4.8 |

*Hardness as French hardness (FH); 1° FH = 10 ppm $2Ca^{2+}/1\ Mg^{2+}$ calcualted as $CaCO_3$.

The composition is tested at a series of wash water concentrations spanning the effective dosasge range of 0.1 to 4 ppm Mn (III) in a 15-minute wash at 40° C. at a constant initial water hardness of 12° FH. The bleaching effects on tea-stained cloth measured by delta R are given in Table II.

TABLE II

| ppm Mn(III) | ΔR |
|---|---|
| 0 | 1.4 |
| 0.2 | 3.9 |
| 0.4 | 6.2 |
| 0.6 | 7.2 |
| 0.8 | 6.9 |
| 1.2 | 7.7 |
| 1.5 | 7.6 |
| 2.0 | 6.8 |
| 4.0 | 4.0 |
| 5.0 | 0.8 |

EXAMPLE III

The following detergent bleach composition is formulated:

| Component | % by Weight |
|---|---|
| sodium C-12 alkyl benzene sulfonate | 9.6 |
| Neodol 45-13 | 3.2 |
| sodium carbonate | 40.9 |
| sodium tripolyphosphate | 5.8 |
| sodium silicate | 2.9 |
| sodium hydroxide | 1.1 |
| Dequest 2006 | 1.2 |
| sodium perborate monohydrate | 23.4 |
| catalyst | 11.7 |

The composition is tested at a series of 40° C. wash water concentrations spanning the effective dosage range of 0.1 to 4 ppm Mn(III) for 15 minutes each. Table III shows the change in reflectance (ΔR) of tea-stained cloth as a function of manganese concentration at an initial water hardness of 9° FH.

TABLE III

| Mn(ppm) | R |
|---|---|
| 0.0 | 1.6 |
| 0.2 | 4.1 |
| 0.4 | 5.7 |
| 0.6 | 7.2 |
| 0.8 | 8.8 |
| 1.0 | 9.6 |
| 1.5 | 11.1 |
| 2.0 | 11.8 |
| 2.4 | 8.1 |
| 3.1 | 7.2 |
| 3.5 | 2.4 |
| 4.0 | 2.0 |
| 5.0 | 0.5 |

EXAMPLE IV

The following detergent composition (without perborate or catalyst) is formulated:

| Component | % by Weight |
|---|---|
| Sodium C-12 alkyl benzene sulfonate | 9.6 |
| Neodol 45-13 | 3.2 |
| sodium carbonate | 40.9 |
| sodium tripolyphosphate | 5.8 |
| sodium silicate | 2.9 |
| sodium hydroxide | 1.1 |
| Dequest 2006 | 1.2 |
| sodium sulfate (filler) | 35.1 |

EXAMPLE V

The following detergent composition (without catalyst) is formulated:

| Component | % by Weight |
|---|---|
| sodium C-12 alkyl benzene sulfonate | 9.6 |
| Neodol 45-13 | 3.2 |
| sodium carbonate | 40.9 |
| sodium tripolyphosphate | 5.8 |
| sodium silicate | 2.9 |
| sodium hydroxide | 1.1 |
| Dequest 2006 | 1.2 |
| sodium perborate monohydrate | 23.4 |
| sodium sulfate | 11.7 |

EXAMPLE VI

The following detergent composition (with perborate and catalyst) is formulated:

| Component | % by Weight |
|---|---|
| sodium C-12 alkyl benzene sulfonate | 9.6 |
| Neodol 45-13 | 3.2 |
| sodium carbonate | 40.9 |
| sodium tripolyphosphate | 5.8 |
| sodium silicate | 2.9 |
| sodium hydroxide | 1.1 |
| Dequest 2006 | 1.2 |
| sodium perbonate monohydrate | 23.4 |
| catalyst | 11.7 |

Table IV shows the change in reflectance of wine-stained cloth using the formulations of Examples IV, V and IV each at an initial water hardness of 12 FH.

TABLE IV

| Composition | ΔR |
|---|---|
| Ex. IV (without perborate or catalyst) | 11.6 |
| Ex. V (without catalyst) | 18.8 |
| Ex. VI (with perborate and catalyst) | 25.1 |

Table IV demonstrates the benefit of the added peroxide bleaching agent and the further benefit which may be obtained through use of the catalyst.

EXAMPLE VII

Hydrolytic stability of the catalysts of the invention is defined in terms of the water-solubility of the manganese at a pH of 10 to 11. Oxidative stability is defined in terms of the water-solubility of manganese at a pH of 10 to 11 in the presence of strong oxidizing agents such as hypochlorite. Stability tests are run at a mole ratio of 10 ligand/1 $Mn^{2+}$ (0.5 mmol ligand/0.05 mmol $Mn^{+2}$). The pH is raised to 11 with 1 N NaOH and the solution is allowed to stand at room temperature for 30 min. If the solution remains homogeneous then 5 mmol hypochlorite is added and the system is allowed to stand for 2 hours.

TABLE V

| Ligand | Hydrolytic Stability | Oxidative Stability |
|---|---|---|
| picolinic acid | no | — |
| NTA | yes | no |
| Dequest 2006 | yes | no |
| Dequest 2041* | yes | no |
| EDTA | yes | no |
| gluconate | yes | yes |
| glucoheptonate | yes | yes |
| Tiron** | yes | no |
| polyacrylic acid (MW = 2400) | yes | no |
| sulfosalicylic acid | no | — |
| saccharic acid | yes | yes |
| DETPA | yes | no |
| quinic acid | yes | yes |
| glucaronic acid | yes | no |
| galacturonic acid | yes | yes |
| gulonic acid | yes | yes |

**Tiron = 4,5-dihydroxy-1,3-benzenedisulfonic acid disodium salt monohydrate
*Dequest 2041 = Ethylenediaminetetra(methylenephosphonic acid)

From the data in Table V it can be seen that quinic acid meets the requirement for hydrolytic and oxidative stability and is suitable for use according to the present invention even though it differs in chemical structure from the general class of suitable complexing agents which are hydroxycarboxylic acids containing at least 5 carbon atoms according to formula I, above.

I claim:

1. A detergent bleach composition comprising:

(a) from about 2% to about 50% by weight of the composition of a surface active agent selected from the group consisting of nonionic, anionic, cationic, and zwitterionic detergents and mixtures thereof;

(b) from about 1% to about 85% by weight of the composition of a detergent builder; and (c) a bleaching agent containing (i) from about 5% to about 30% by weight of the composition of a peroxide compound having a bleaching action; and (ii) a catalyst for the bleaching action of the peroxide compound, comprising a complex of manganese (III) and a multidentate ligand supplied by a complexing agent, said agent selected from the group consisting of hydroxy carboxylic acids containing at least 5 carbon atoms and the salts, lactones, acid esters, ethers an boric esters thereof, and wherein the molar ratio of complexing agent to manganese is at least about 1:1, the catalyst being present in an amount such that the manganese content is about 0.005% to about 0.2% of the weight of the composition.

2. A composition according to claim 1 wherein the peroxide compound is present in about 15% to about 25% by weight and the catalyst is present in an amount such that the manganese content is about 0.025% to about 0.125% by weight of the composition.

3. A composition according to claim 1 wherein the peroxide compound is selected from the group consisting of water-soluble inorganic persalts which yield hydrogen peroxide when dissolved in water.

4. A composition according to claim 3 wherein the inorganic persalt is an alkali metal perborate, percarbonate, perphosphate, persilicate or mixture thereof.

5. A composition according to claim 1 wherein the hydroxycarboxylic acid possesses a hydroxyl group on each of the carbon atoms other than the carboxyl carbon.

6. A composition according to claim 1 wherein the hydroxycarboxylic acid is a straight-chain acid having an aldehyde or carboxylate group on the carbon atom farthest from the carboxyl carbon and each of the remaining carbon atoms other than the carboxyl carbon has a hydroxyl group.

7. A composition according to claim 1 wherein the hydroxycarboxylic acid is a hexonic hydroxyacid selected from the group consisting of gluconic acid, gulonic acid, idonic acid and mannoic acid.

8. A composition according to claim 1 wherein the hydroxycarboxylic acid is a uronic acid selected from the group consisting of glucouronic acid, galactouronic acid, and mannuronic acid.

9. A composition according to claim 1 wherein the hydroxycarboxylic acid is a heptonic hydroxyacid selected from the group consisting of glucoheptonic acid and its stereoisomers.

10. A composition according to claim 1 wherein the hydroxycarboxylic acid is a sugar selected from the group consisting of saccharic acid and isosaccharic acid.

11. A composition according to claim 1 wherein the hydroxycarboxylic acid is quinic acid.

12. An aqueous wash medium comprising:

(a) from about 0.04% to about 2% by weight of the composition of a surface active agent selected from nonionic, anionic, cationic, and zwitterionic detergents;

(b) from about 0.02% to about 3.4% by weight of the composition of a detergent builder;

(c) from about 0.1% to about 1.2% by weight of the composition of a peroxide compound having a bleaching action; and (d) a catalyst for the bleaching action of the peroxide compound, comprising manganese (III) or a precursor thereof, and a multidentate ligand-supplying complexing agent, said agent selected from the group consisting of hydroxy carboxylic acids containing at least 5 carbon atoms and the salts, lactones, acid esters, ethers and boric esters thereof, and wherein the molar ratio of complexing agent to manganese is at least about 1:1, the catalyst being present in an amount such that the manganese content is about 0.00006% to about 0.004% of the weight of the composition.

13. An aqueous medium according to claim 12 wherein the peroxide compound is present in about 0.6% to about 1.0% by weight and the catalyst is present in an amount such that the manganese content is about 0.00032% to about 0.005% by weight.

14. An aqueous medium according to claim 12 wherein the peroxide compound is selected from the group consisting of hydrogen peroxide and inorganic persalts which when in water yield hydrogen peroxide.

15. An aqueous medium according to claim 14 wherein the inorganic persalt is an alkali metal perborate, percarbonate, perphosphate, or persilicate.

16. An aqueous medium according to claim 12 wherein the hydroxycarboxylic acid posses a hydroxyl group on each of the carbon atoms other than the carboxyl carbon.

17. An aqueous medium according to claim 12 wherein the hydroxycarboxylic acid is a straight-chain acid having an aldehyde or carboxylate group on the carbon atom farthest from the carboxyl carbon and each of the remaining carbon atoms other than the carboxyl carbon has a hydroxyl group.

18. An aqueous medium according to claim 12 wherein the hydroxycarboxylic acid is a hexonic hydroxyacid selected from the group consisting of gluconic acid, gulonic acid, idonic acid and mannoic acid.

19. An aqueous medium according to claim 12 wherein the hydroxycarboxylic acid is a uronic acid selected from the group consisting of glucouronic acid, galactouronic acid, and mannuronic acid.

20. An aqueous medium according to claim 12 wherein the hydroxycarboxylic acid is a heptonic hydroxyacid selected from the group consisting of glucoheptonic acid and its stereoisomers.

21. An aqueous medium according to claim 12 wherein the hydroxycarboxylic acid is a sugar selected from the group consisting of saccharic acid and isosaccharic acid.

22. A bleaching agent composition comprising:

(a) a peroxide compound present in an amount effective to impart a bleaching action; and (b) a catalyst present in an effective amount to promote the bleaching action of the peroxide compound, comprising a complex of manganese (III) and a multidentate ligand supplied by a complexing agent, said agent selected from the group consisting of hydroxy carboxylic acids containing at least 5 carbon atoms and the salts, lactones, acid esters, ethers and boric esters thereof, and wherein the molar ratio of complexing agent to manganese is at least about 1:1.

23. A composition according to claim 22 wherein the peroxide compound is selected from the group consisting of inorganic persalts which when in water yield hydrogen peroxide.

24. A composition according to claim 23 wherein the inorganic persalt is alkali metal perborate, percarbonate, perphosphate or persilicate or mixture thereof.

25. A composition according to claim 22 wherein the hydroxycarboxylic acid possesses a hydroxyl group on each of the carbon atoms other than the carboxyl carbon.

26. A composition according to claim 22 wherein the hydroxycarboxylic acid is a straight-chain acid having an aldehyde or carboxylate group on the carbon atom farthest from the carboxyl carbon and each of the remaining carbon atoms other than the carboxyl carbon has a hydroxyl group.

27. A composition according to claim 22 wherein the hydroxycarboxylic acid is a hexonic hydroxyacid selected from the group consisting of gluconic acid, gulonic acid, idonic acid and mannoic acid.

28. A composition according to claim 22 wherein the hydroxycarboxylic acid is a uronic acid selected from the group consisting of glucouronic acid, galactouronic acid, and mannuronic acid.

29. A composition to claim 22 wherein the hydroxycarboxylic acid is a heptonic hydroxyacid selected from the group consisting of glucoheptonic acid and its stereoisomers.

30. A composition according to claim 22 wherein the hydroxycarboxylic acid is a sugar selected from the group consisting of saccharic acid and isosaccharic acid.

31. A catalyst present in an effective amount to promote the bleaching action of peroxide compounds in a detergent bleach composition, comprising a complex of manganese (III) and a multidentate ligand supplied by a complexing agent, said agent selected from the group consisting of hydroxy carboxylic acids containing at least 5 carbon atoms and the salts, lactones, acid esters, ethers and boric esters thereof, and wherein the molar ratio of complexing agent to manganese is at least about 1:1.

32. A catalyst according to claim 31 wherein the hydroxycarboxylic acid possesses a hydroxyl group on each of the carbon atoms other than the carboxyl carbon.

33. A catalyst according to claim 31 wherein the hydroxycarboxylic acid is a straight-chain acid having an aldehyde or carboxylate group on the carbon atom farthest from the carboxyl carbon and each of the remaining carbon atoms other than the carboxyl carbon has a hydroxyl group.

34. A catalyst according to claim 31 wherein the hydroxycarboxylic acid is a hexonic hydroxyacid selected from the group consisting of glucouronic acid, gulonic acid, idonic acid and mannonic acid.

35. A catalyst according to claim 31 wherein the hydroxycarboxylic acid is a uronic acid selected from the group consisting of glucoronic acid, galactouronic acid, and mannuronic acid.

36. A catalyst according to claim 31 wherein the hydroxycarboxylic acid is a heptonic hydroxyacid selected from the group consisting of glucoheptonic acid and its stereoisomers.

37. A catalyst according to claim 31 wherein the hydroxycarboxylic acid is a sugar selected from a group consisting of saccharic acid and isosaccharic acid.

38. A method for preparing the catalyst of claim 31, comprising:

(a) preparing an aqueous solution of (i) a source of manganese (III) and (ii) a multidentate ligand-supplying complexing agent wherein the molar ratio of the complexing agent to manganese is at least about 1:1;

(b) adjusting the solution prepared in step (a) to a pH of between about 9 and about 12; and (c) agitating the solution obtaining in step (b) in air to form a water-soluble complex of manganese (III) with the multidentate ligand.

39. A method according to claim 38 wherein the source of manganese (III) is a manganese (II) salt.

40. A method according to claim 39 wherein:

the manganese (II) salt is manganese (II) sulfate;

the complexing agent is sodium gluconate; and the pH is adjusted in step (b) to a pH of about 10 using sodium hydroxide.

41. A method according to claim 39 wherein the molar ratio of the complexing agent to manganese is between about 10:1 and 100:1.

42. A method according to claim 39 wherein, the water is removed from the complex formed in step (c).

* * * * *